US009472170B2

(12) United States Patent
Ceja Estrada

(10) Patent No.: US 9,472,170 B2
(45) Date of Patent: Oct. 18, 2016

(54) GUITAR

(71) Applicant: Juan Jose Hugo Ceja Estrada, Sinaloa (MX)

(72) Inventor: Juan Jose Hugo Ceja Estrada, Sinaloa (MX)

( * ) Notice: Subject to any disclaimer, the term of this patent is extended or adjusted under 35 U.S.C. 154(b) by 0 days.

(21) Appl. No.: 14/824,312

(22) Filed: Aug. 12, 2015

(65) Prior Publication Data

US 2016/0035326 A1 Feb. 4, 2016

Related U.S. Application Data

(63) Continuation-in-part of application No. 14/114,869, filed as application No. PCT/MX2011/000052 on May 4, 2011, now abandoned.

(51) Int. Cl.

| | |
|---|---|
| ***G10D 1/08*** | (2006.01) |
| ***G10D 3/00*** | (2006.01) |
| ***G10D 3/02*** | (2006.01) |
| ***G10D 3/04*** | (2006.01) |
| ***G10D 3/12*** | (2006.01) |

(52) U.S. Cl.

CPC ..... *G10D 1/08* (2013.01); *G10D 1/085* (2013.01); *G10D 3/00* (2013.01); *G10D 3/02* (2013.01); *G10D 3/04* (2013.01); *G10D 3/12* (2013.01)

(58) Field of Classification Search

CPC ..... G10D 1/08; G10D 3/02; G10D 3/04; G10D 3/00

USPC ..... 84/267, 298, 294, 299, 291

See application file for complete search history.

(56) References Cited

U.S. PATENT DOCUMENTS

| | | | | | |
|---|---|---|---|---|---|
| 2,740,313 | A * | 4/1956 | McCarty | G10D 3/04 | 84/298 |
| 2,918,837 | A * | 12/1959 | Webster | G10D 3/04 | 84/312 R |
| 3,440,921 | A * | 4/1969 | McCarty | G10D 3/04 | 84/307 |
| 3,605,545 | A * | 9/1971 | Rendell | G10D 3/04 | 84/291 |
| 4,178,827 | A * | 12/1979 | Mallory | G10D 3/02 | 84/291 |
| 4,291,607 | A * | 9/1981 | Kauffman | G10D 3/04 | 84/299 |
| 4,430,919 | A * | 2/1984 | Matsui | G10D 3/04 | 84/299 |
| 4,638,711 | A * | 1/1987 | Stroh | G10D 3/12 | 84/298 |
| 4,688,461 | A * | 8/1987 | Stroh | G10D 3/12 | 84/267 |
| 5,637,818 | A * | 6/1997 | Fishman | G10D 3/04 | 84/267 |
| 5,814,745 | A * | 9/1998 | Feiten | G10D 3/14 | 84/312 R |
| 7,327,109 | B1 * | 2/2008 | Hagen | G10D 3/04 | 318/298 |
| 7,674,963 | B1 * | 3/2010 | Poggi | G10D 3/02 | 84/312 R |
| 8,748,717 | B2 * | 6/2014 | Mason | G10D 3/04 | 84/298 |
| 2004/0074373 | A1 * | 4/2004 | Goto | C23C 18/36 | 84/452 R |
| 2004/0134329 | A1 * | 7/2004 | Turner | G10D 3/04 | 84/298 |
| 2007/0214934 | A1 * | 9/2007 | Hendricks | G10D 3/04 | 84/313 |
| 2008/0190263 | A1 * | 8/2008 | Drew | G10D 3/02 | 84/291 |
| 2009/0205477 | A1 * | 8/2009 | Stadler | G10D 3/04 | 84/299 |
| 2010/0275756 | A1 * | 11/2010 | Woodland | G10D 3/04 | 84/307 |
| 2012/0103171 | A1 * | 5/2012 | Lashbrook | G10D 3/04 | 84/731 |
| 2012/0186414 | A1 * | 7/2012 | Swenney | G10D 3/04 | 84/307 |
| 2013/0019736 | A1 * | 1/2013 | Finkle | G10D 3/00 | 84/313 |
| 2013/0055876 | A1 * | 3/2013 | Mason | G10D 3/04 | 84/298 |
| 2014/0144307 | A1 * | 5/2014 | Ceja Estrada | G01D 1/08 | 84/294 |

* cited by examiner

*Primary Examiner* — David Warren
*Assistant Examiner* — Christina Schreiber
(74) *Attorney, Agent, or Firm* — Defillo & Associates; Evelyn A. Defillo

(57) ABSTRACT

The present invention relates to an improvement to a guitar or other stringed instrument in the part which houses the bridge which holds the strings and transmits the vibration to the instrument case.

3 Claims, 7 Drawing Sheets

GUITAR

REFERENCE TO RELATED APPLICATIONS

This application is a continuation-in-part of U.S. application Ser. No. 14/114,869 filed Oct. 30, 2014, entitled, IMPROVEMENTS TO A GUITAR, pending, the content of which is incorporated herein by reference, which is a US national stage entry of PCT/MX2011/000052 filed May 4, 2011, under the International Convention.

FIELD OF THE INVENTION

The present invention relates to an improvement to a guitar or other stringed instrument in the part which houses the bridge which holds the strings and transmits the vibration to the instrument case.

BACKGROUND OF THE INVENTION

As is known, classical guitars are made from a sounding, hollow front hole on establishing a set of six strings running through the mast, which can be stretched at will by pin operatively arranged in the end of said mast, complementing this set with a plurality of frets, bone or metal, disposed transversely to the mast with a progressively increasing distance from the casing to the free end of said mast.

The bridge of a guitar or other stringed instrument, is a part that holds the strings and transmits the vibration to some other structural component of the instrument in order to transfer the sound to the air.

Most string instruments produce sound by applying energy to the strings to bring them into vibratory motion. But the strings by themselves, produce sound by vibrating weak because only a very small volume moving air. Therefore, it is necessary that the sound of the strings have any impedance matching with the surrounding air to transmit its vibrations to a larger surface area capable of moving large volumes of air (and thus produce louder sounds). The device used for this is the bridge that allows free vibrating strings, yet these vibrations efficiently leads to greater surface area (usually called soundboard).

Typically, the bridge is placed perpendicular to the strings and the larger surface area (which are approximately parallel to each other) with the string tension pressing on the bridge and therefore the surface of largest area under the bridge. This large surface area has increased acoustic response and may be coupled to a soundboard which is a box-like body of the guitar or the violin, which helps amplify the sound. Depending on the type of string instrument, the resonant surface on which sits the bridge can be built of wood, and the top cover (harmonic) of a guitar or violin calfskin or plastic, such as the banjo, of metal, such as certain types resophonic fretted instruments, or any other material to vibrate in a coupled manner with the strings.

The bridge must transfer the vibration to the soundboard or other surface amplifier. When the strings are set in motion, the bridge transmits the vibration to flex in one direction and the other in the direction of the rope, at a frequency which is twice the vibration frequency of the string. This makes the soundboard at the same frequency to vibrate the string producing a movement and an audible sound wave.

Bridges are designed to keep the strings at a suitable height above the instrument diapason or fingerboard. The ideal height of the bridge is one that generates a rope angle such that it produces sufficient downward force to move the lid, but which in turn the ropes located sufficiently close to the fork to facilitate the crushing of the strings. There are bridges and other fixed height adjustable height.

Besides supporting the strings and transmit their vibrations, the bridge also controls the spacing between the strings. This is achieved through small slits cut into the bridge or saddle. The strings are recorded in these slots and thus are retained in their lateral position.

The present invention provides a solution to a typical problem in classical guitars and other stringed instruments, where the bridge tends to rise with use.

The prior art shows discloses a guitar equipped with means to prevent direct contact between the body and the person playing the instrument case, so that the problem does not occur loudness reduction of traditional guitars. Guitar addition the invention is characterized in that it has on the outside of the box rear panel sections and three side walls all made of wood. Although the above invention relates to the improvement of a more specific guitar called a Spanish guitar does not tackle the problems that are usually present on the bridge.

In addition, the prior art shows an enhanced capo for guitars and the like where the inventor has designed a new system built wood nut that fits the criteria of the players, however, it does not refer to an improvement in the problems encountered in the mast.

Furthermore, the prior art shows a series of improvements in the structuring of guitars, which are oriented towards obtaining a substantial improvement in the sound of them. In particular the invention says that at the mercy of the nature of the strings from the "thinner string which produces a brighter sound to the thicker string which produces a deeper sound, and by the effective shortening of any of such strings, by manual pressure on them in the space defined between two consecutive frets, you get a wide range of tones that gives the guitar its functionality as such musical element. However, said patent does not address the problems that arise in the bridge, which when the position changes, the sound quality will be lost.

SUMMARY OF THE INVENTION

The present invention significantly improves the functioning of a guitar, in particular, we solve the old problem that represents the shedding of the bridge with the use or poor quality adhesive materials.

The invention provides a simple, strength, deformability, aesthetics, perfect adaptation and economy.

The object of the present invention to provide an alternative to the stringed instruments, especially guitars, with the proposal of using fasteners to the bridge, and the glue that has traditionally been used by manufacturers of such instruments.

The above-mentioned clamping means can be of various types, namely screws or rivets, stainless materials are preferably proposed which could be hidden in the material forming the bridge.

Generally, the section of material forming the bridge can be a type of wood and the shape can be rectangular, such as those conforming the conventional guitars. The proposal of the present invention is to place the screws on both sides of the rectangle that forms the improved bridge, holding it from the front cover of the instrument, and using means to clamp without damaging the constituent material of the top or soundboard of the instrument.

The stringed instrument according to the present invention includes a body having a front cover and a back cover; a mast projecting from the body; hole located on the body;

a bridge located on the body, the bridge including a longitudinal slit; a saddle secure to the longitudinal slit of the bridge, the saddle is fixed to the bridge; a plurality of strings running between the mast and the bridge and supported by recesses located on the saddle; a plurality of frets disposed transversally to the mast; a fastening system to attach the bridge to the front cover of the stringed instrument, the fastening system includes: fasteners having a body and a head; washers, and nuts; the fastening system is secured on ends of said bridge; the body of the fastener passes through the bridge and is secured on the back of the front cover by using the washers and nuts.

BRIEF DESCRIPTION OF THE INVENTION FIGURES

To complement the description being made and in order to aid a better understanding of the characteristic of the invention, attached to this specification as an integral part thereof, the drawings in an illustrative and non-limiting is represented as follows.

DETAILED DESCRIPTION OF THE INVENTION

Figure 1:
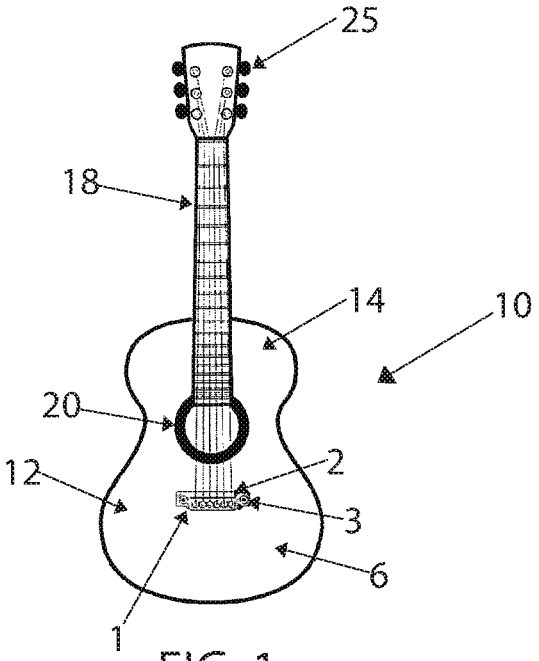
FIG. 1 shows a front view of a stringed instrument constructed in accordance with the present invention.

With reference to the accompanying FIGS. 1-12, the stringed instrument 10 according to the present invention includes a body 12 having a front cover 14 and a back cover 7; a mast 18 projecting from the body 12; a hole 20 located on the body 12; a bridge 1 located on the body 12; a saddle 2 secure to the bridge 1; a plurality of strings 22 running between the mast 18 and the bridge 1 and supported by recesses 24 (FIG. 12) located on the saddle 2; a plurality of frets 25 disposed transversally to the mast 18; a fastening system to attach the bridge 1 to the front cover 14 of the stringed instrument 10, the fastening system is secured on ends 26 of said bridge 1; the fastening system includes: fasteners 3 having a body 28 and a head 30, washers 5, and nuts 4. The head 30 of the fastener 3 is completely hidden inside the bridge 1. The body 28 of the fastener 3 passes through the bridge 1, and is secured on the back 36 of the front cover 14 by using the washers 5, and nuts 4.

The stringed instrument 10 may be, for example, an acoustic guitar.

The bridge 1 may include a longitudinal slit 38. The saddle 2 may be connected to the bridge 1 by pressing (pressure) the saddle 2 into the slit 38. In some embodiment, as a extra measurement, glue and other adhesives may be also use.

The saddle 2 may be made of a harder material than that of the bridge 1, such as, bone, ivory, plastic or metal. The saddle 2 is fixed to the bridge 1 and cannot its height cannot be adjusted.

Preferably, the fastener 3 may be screws, rivets 11, Allen screws, shovel screws, slot head screws 8, or Philips screws 9.

Figure 2:
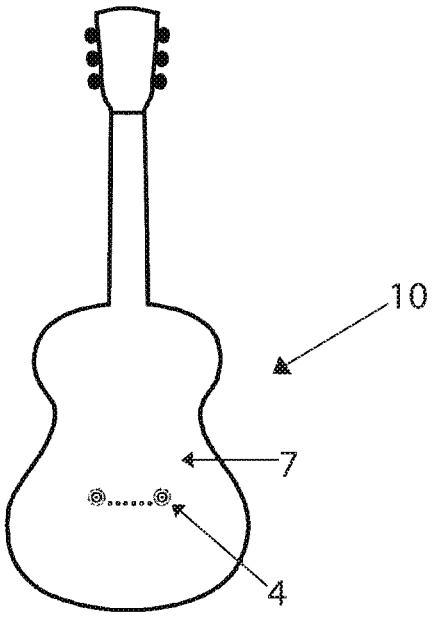
FIG. 2 shows a the back of the front cover of the string instrument of FIG. 1.
Figure 3:
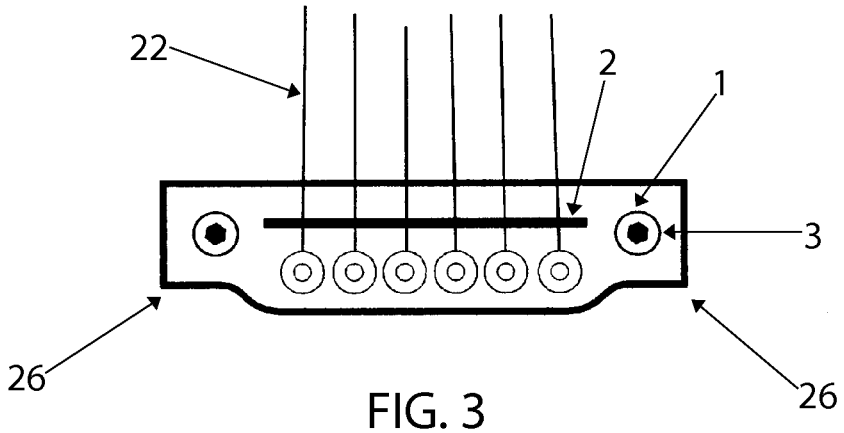
FIG. 3 shows a front view of the bridge of FIG. 1 showing the saddle.
Figure 4:
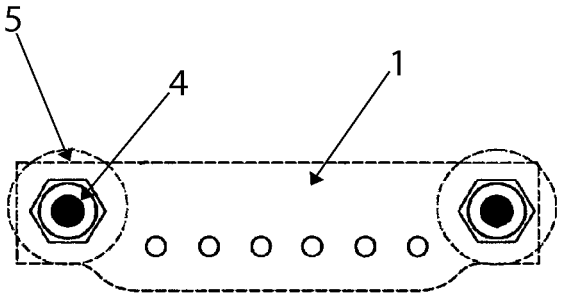
FIG. 4 shows a front view bridge without the saddle.
Figure 5:
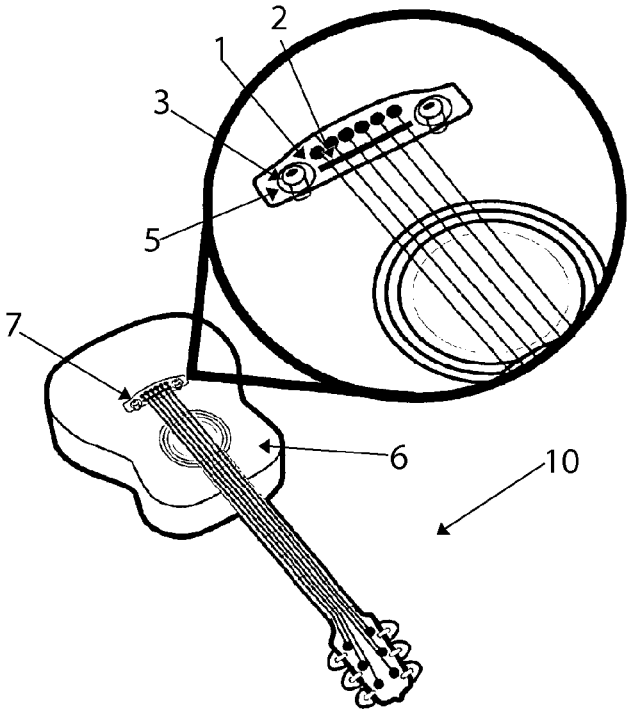
FIG. 5 shows an enlarged view of the bridge of FIG. 1.
Figure 6:
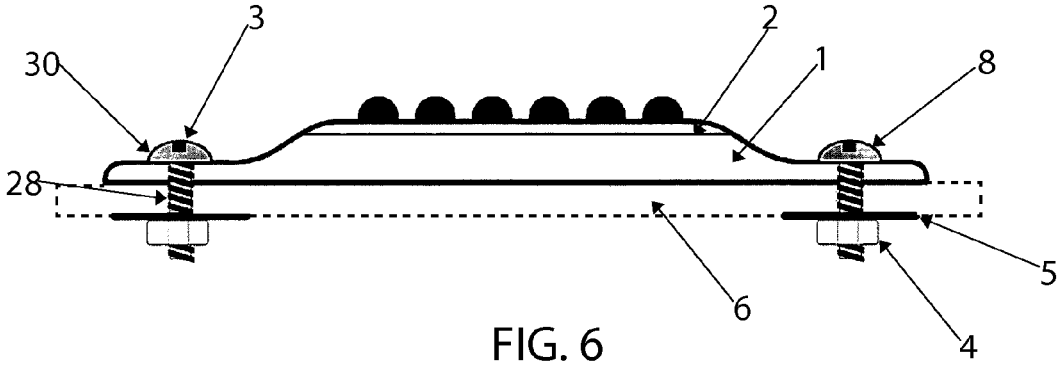
FIG. 6 shows a side view of the bridge and saddle of FIG. 1 showing the bridge saddle to the stringed instrument by shovel type screws.
Figure 7:
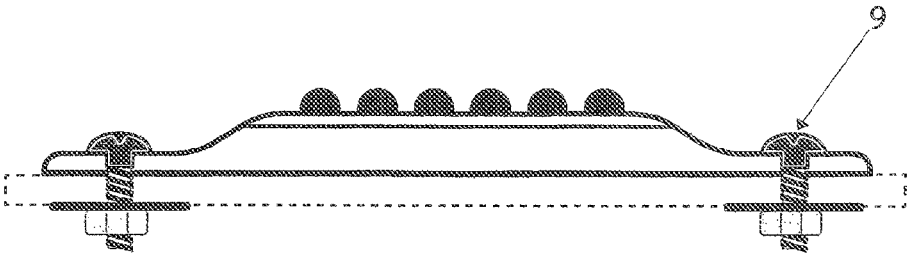
FIG. 7 shows a side view of the bridge and saddle of FIG. 1 showing the bridge saddle to the stringed instrument by cross type screws.
Figure 8:
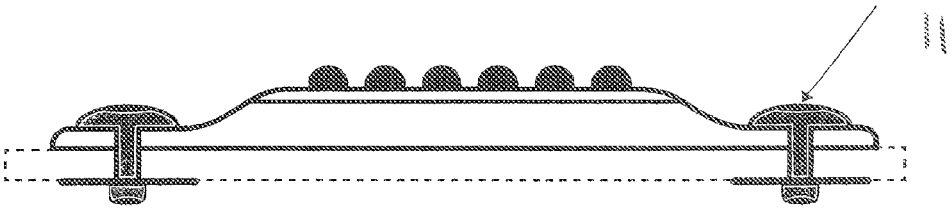
FIG. 8 shows a side view of the bridge and saddle of FIG. 1 showing the bridge saddle to the stringed instrument by rivets.
Figure 9:
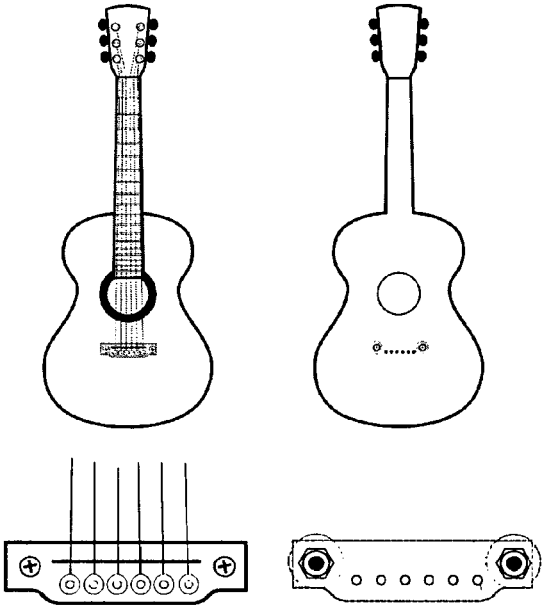
FIG. 9 shows a front view of the front face and the back face of the front cover of the stringed instrument according to FIG. 6.
Figure 10:
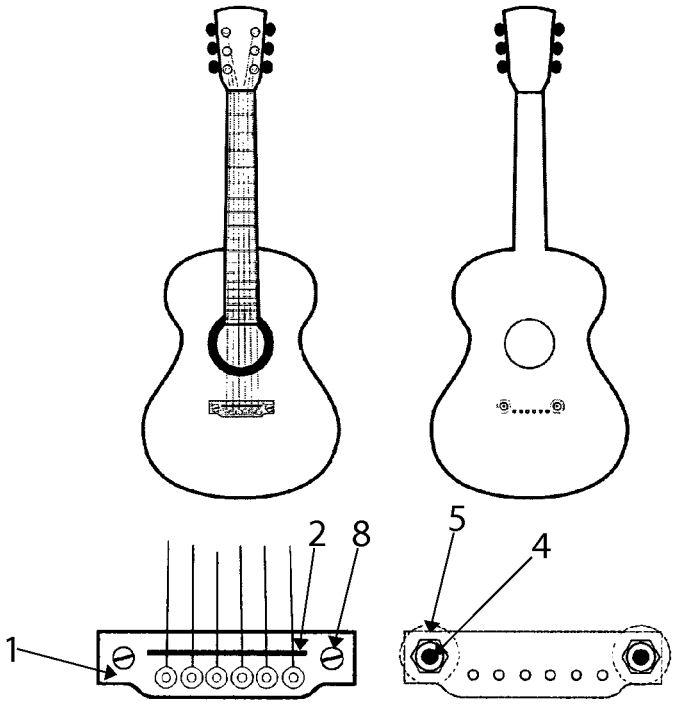
FIG. 10 shows a front view of the front face and the back face of the front cover of the stringed instrument according to FIG. 7.
Figure 11:
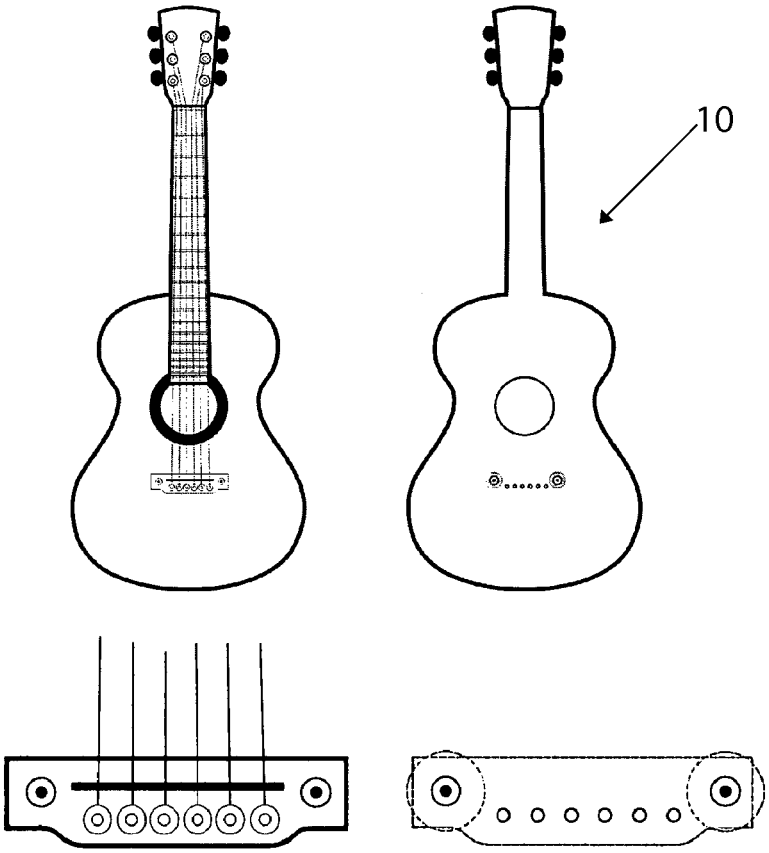
FIG. 11 shows a front view of the front face and the back face of the front cover of the stringed instrument according to FIG. 8.
Figure 12:
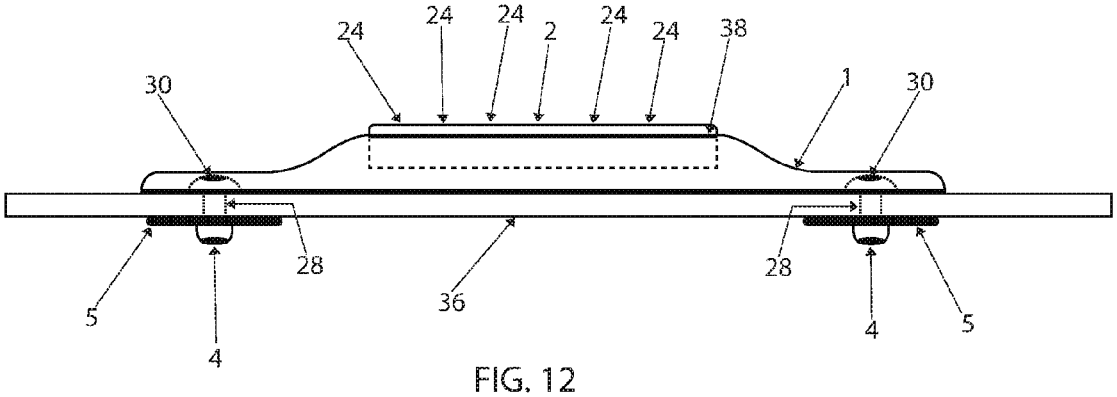
FIG. 12 shows a side view of the bridge and saddle according showing the fasteners completely hidden within the material forming the bridge.

FIG. 2 shows a the back 7 of the string instrument of FIG. 1.

As shown in the Figures, the flat washer 5 distributes the pressure of the out 4 over the wood of the front cover 6 of the stringed instrument 10.

As the bridge 1 is usually subjected to vibration, the present invention contemplates that the bridge must be screwed to the front cover 6 in harmony with the glue used by the manufacturer. The presence of the fastening system in addition to the glue prevents the potential failures of the glue, which usually is detached taking off chips the wood that forms the top cover of a guitar or other stringed instrument.

As can be seen from the Figures, the fastening system are placed in a position (end of the bridge) that does not affect the functioning of the bridge or the saddle 2 as a support for the strings.

The head 30 of the fastener 3 may be completely hidden within the material forming the bridge 1.

The intensity and quality of the sound of a guitar or other stringed instrument depends mainly on the characteristics of the case, such as construction type or system thereof, type of wood used, etc. It is also important to note that if a bridge is located in the appropriately facilitate intonation and loudness regulation and avoiding discomfort mainly guitarist or other musician of strings in some chords, especially in the execution of topics stylists.

The present invention is given not in any known stringed instrument and this is an interesting innovation, because it's adaptation of the fastening means are placed in perfect coincidence geometric, allowing no risk of alteration in the intensity and quality of musical instrument sound.

Having sufficiently described my invention, I think as a novelty and the claim both as my sole property, the matter contained in the following:

What is claimed is:

1. A stringed instrument consisting of:

a body having a front cover and a back cover;

a mast projecting from the body;

a hole located on the body;

a bridge located on the body, the bridge including a longitudinal slit located on a top end of the bridge;

a saddle secure to the longitudinal slit of the bridge, the saddle is fixed to the bridge;

a plurality of strings running between the mast and the bridge and supported by recesses located on the saddle;

a plurality of frets disposed transversally to the mast;

a fastening system to attach the bridge to the front cover of the stringed instrument, the fastening system consisting of:

fasteners having a body and a head;

washers, and nuts;

wherein the fastening system is secured on ends of said bridge;

wherein the body of the fastener passes through the bridge and is secured on the back of the front cover by using the washers and nuts.

2. A stringed instrument consisting of:

a body having a front cover and a back cover;

a mast projecting from the body;

a hole located on the body;

a bridge located on the body, the bridge including a longitudinal slit located on a top end of the bridge;

a saddle secure to the longitudinal slit of the bridge, the saddle is fixed to the bridge;

a plurality of strings running between the mast and the bridge and supported by recesses located on the saddle;

a plurality of frets disposed transversally to the mast;

a fastening system to attach the bridge to the front cover of the stringed instrument, the fastening system consisting of:

fasteners having a body and a head;

washers, and nuts;

wherein the fastening system is secured on ends of said bridge;

wherein the body of the fastener passes through the bridge and is secured on the back of the front cover by using the washers and nuts;

wherein the head of the fastener is completely hidden inside the bridge.

3. A stringed instrument consisting of:

a body having a front cover and a back cover;

a mast projecting from the body;

a hole located on the body;

a bridge located on the body, the bridge including a longitudinal slit located on a top end of the bridge;

a saddle secure to the longitudinal slit of the bridge, the saddle is fixed to the bridge;

a plurality of strings running between the mast and the bridge and supported by recesses located on the saddle;

a plurality of frets disposed transversally to the mast;

a fastening system to attach the bridge to the front cover of the stringed instrument, the fastening system consisting of:

fasteners having a body and a head;

washers, and nuts;

wherein the fastening system is secured on ends of said bridge;

wherein the body of the fastener passes through the bridge and is secured on the back of the front cover by using the washers and nuts; and wherein the stringed instrument is an acoustic guitar.

* * * * *